US005406358A

United States Patent [19]

Kimura et al.

[11] Patent Number: 5,406,358

[45] Date of Patent: Apr. 11, 1995

[54] IMAGE FORMING APPARATUS HAVING RECORDING MATERIAL CARRYING MEMBER

[75] Inventors: Koji Kimura, Tokyo; Koh Hirai, Yokohama, both of Japan

[73] Assignee: Canon Kabushiki Kaisha, Tokyo, Japan

[21] Appl. No.: 134,653

[22] Filed: Oct. 13, 1993

[30] Foreign Application Priority Data

Oct. 13, 1992 [JP] Japan ..... 4-300475
Oct. 21, 1992 [JP] Japan ..... 4-305879

[51] Int. Cl.[6] ..... G03G 15/00
[52] U.S. Cl. ..... 355/271; 355/326 R
[58] Field of Search ..... 355/271-274, 355/326 R, 327, 311

[56] References Cited

U.S. PATENT DOCUMENTS 5,086,318 2/1992 Takeda et al. ..... 355/271
5,132,736 7/1992 Muramatsu et al. ..... 358/271
5,168,290 12/1992 Tanaka et al. ..... 346/134
5,239,347 8/1993 Onodera et al. ..... 355/274

FOREIGN PATENT DOCUMENTS 0339309 11/1989 European Pat. Off. .
0372813 6/1990 European Pat. Off. .
61-73976 4/1986 Japan ..... 355/271
61-138263 6/1986 Japan .
63-177181 7/1988 Japan .
3-004239 1/1991 Japan .

*Primary Examiner*—Joan H. Pendegrass
*Attorney, Agent, or Firm*—Fitzpatrick, Cella, Harper & Scinto

[57] ABSTRACT

An image forming apparatus includes recording material carrying member for carrying a recording material; an image forming device for forming an image on the recording material carried on the recording material carrying member; a gripper for gripping the recording material on the recording material carrying member; an electrostatic attraction device for attracting a recording material on a recording material carrying member without gripping the recording material by the gripper.

27 Claims, 10 Drawing Sheets

IMAGE FORMING APPARATUS HAVING RECORDING MATERIAL CARRYING MEMBER

FIELD OF THE INVENTION AND RELATED ART

The present invention relates to an image forming apparatus comprising a recording material carrying member for carrying a recording material on which an image is formed, more particularly to an image forming apparatus suitably used as an electrophotographic copying machine or printer capable of forming a full-color image on a recording material.

A color electrophotographic apparatus is known in which a recording material is carried on a recording material carrying member such as a transfer drum, and different color images are superposedly transferred onto the recording material.

As for a method for carrying the recording material on the transfer drum, there are known a method in which a leading edge of the recording material is gripped by a gripper provided on the transfer drum, and a method in which the recording material is electrostatically attracted on the recording material carrying sheet of the transfer drum. When the gripper is used, only one recording material carried even if the peripheral circumferential length of the transfer drum is sufficient to carry to recording materials. In other words, the transfer drum can carry only one irrespective of the size of the recording material, and therefore, the productivity can not be increased. On the other hand, as disclosed in U.S. Pat. No. 5,086,318, the recording material is carried on the transfer drum using electrostatic attraction force by attraction corona charger without use of the gripper on the transfer drum, it is possible to carry a plurality of recording materials on the transfer drum. However, depending on the thickness, rigidity or the degree of curling of the recording material, it is not possible to properly attract the recording material on the transfer drum, with the result of deterioration of the image quality or the jamming of the recording material.

SUMMARY OF THE INVENTION

Accordingly, it is a principal object of the present invention to provide an image forming apparatus and method of high productivity.

It is another object of the present invention to provide an image forming apparatus and method in which the recording material can be properly carried on a recording material carrying member, irrespective of the material, type or nature of the recording material.

It is a further object of the present invention to provide an image forming apparatus and method in which the recording material can be properly carried on a recording material carrying member even if the recording is carried.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
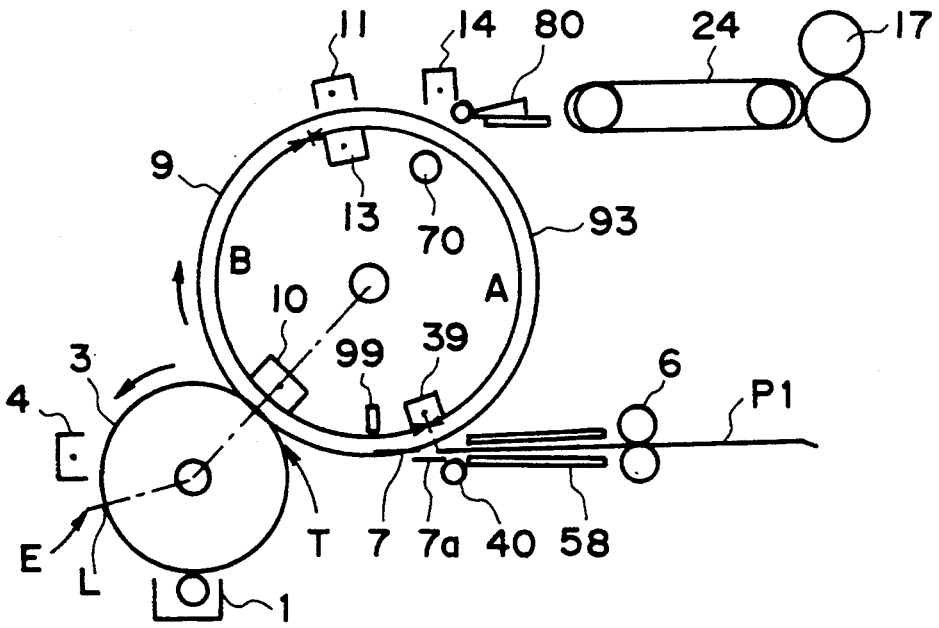
FIG. 1 is a sectional view of a color electrophotographic copying apparatus according to an embodiment of the present invention.

Referring to FIG. 1, there is shown an electrophotographic color copying machine as an exemplary image forming apparatus according to an embodiment of the present invention.

In the image transfer step of the electrophotographic type color copying apparatus, in order to transfer different color images superimposedly, a recording material is carried on a recording material carrying member movable along an endless path, and the image transfer operations are repeated at an image transfer position so that a full-color image or a multi-color image is formed.

The image forming process of the color electrophotographic machine will be briefly described. The copying machine comprises a photosensitive drum functioning as an electrostatic latent image bearing member. The photosensitive drum 3 rotates in a direction indicated by an arrow, and it is uniformly charged by a primary charger disposed adjacent to the photosensitive drum 3. Thereafter, it is exposed to image light at a position L, so that an electrostatic latent image is formed. By the function of the developing apparatus 1, the image is developed with toner.

The transfer material P (recording material) is fed along a sheet feeding guide 58, and is gripped by a gripper 7 movable together with the transfer drum 9, with proper timing provided by registration rollers 6.

The transfer material P gripped by a gripper 7 of the transfer drum 9, reaches a transfer position T by the rotation of the transfer drum 9, and by the electrostatic function of the transfer charger 10 at the transfer position, the developed image is transferred from the photosensitive drum onto the transfer material P.

The gripper 7 is effective to grip the transfer material P to carry it on the transfer drum 9. When the transfer drum 9 is at a predetermined rotational position, and the transfer material P is being fed, the gripper opens in the radial direction of the transfer drum 9 by an operation of a cam. When the leading edge of the transfer material P reaches the gripper 7, the cam operates to close the gripper 7, so that the top side of the leading end of the transfer material P is confined by the gripping portion 7*a* of the gripper 7.

This gripping structure is advantageous in that the carrying and separation of the transfer material relative to the transfer material carrying member are assured. This mechanism is particularly effective when the thickness of the transfer material is large (not less than 128 g/m$^2$ and not more than 180 g/m$^2$, since such a transfer material has high resistivity. In the case of thin transfer material, the mechanism is effective for the separation of the transfer material from the transfer material carrying member, since the rigidity of such a transfer material is low. This is because, when the gripper 7 opens, the lower side of the gripper confining the transfer material is raised, thus raising the leading edge.

In the case of the conventional transfer drum having the gripper, it is not possible to carry one more transfer materials for the purpose of increasing the transfer speed as a whole, even if the length of the transfer material in the feeding direction is so short that the circumferential length of the transfer drum 9 is large enough to support two transfer materials. In consideration, as shown in FIG. 1, the first sheet is carried using the gripper 7, and the second sheet is carried on the surface of the transfer drum by electrostatic force. For the electrostatic attraction, an attraction corona charger 39 is disposed at a position where the contact between the transfer material P and the surface of the transfer drum 9 starts, so that the electrostatic force is provided by the corona charger 39.

In this embodiment, the transfer drum 9 has a diameter of 160 mm, and is capable of carrying one A4 size transfer material P on area A and one A4 size transfer material P on B area in FIG. 1. In this embodiment, the shorter side of the A4 size transfer material is substantially parallel with the feeding direction of the transfer material. When the dimension of the transfer material measured in the transfer material feeding direction is smaller than one half of the peripheral length of the transfer drum, the transfer drum can carry two transfer materials thereon. When the dimension of the transfer material measured in the transfer material feeding direction is larger than one half of the circumferential length of the transfer drum, in the case of A4 size transfer material, for example, the transfer material can carry only one transfer material. When images are formed continuously on a plurality of plain paper sheets (not less than 60 g/m$^2$ and less than 128 g/m$^2$) of small size (A4 size), it is desirable from the standpoint of productivity that two transfer materials are carried on the transfer drum, as described hereinbefore. However, if the transfer material is a thick sheet (not less than 128 g/m$^2$ and not more than 180 g/m$^2$) is used, only one transfer sheet carried on the transfer drum even if the images are continuously formed on the transfer sheet. If the thick sheet is supported electrostatically on the transfer drum without use of the gripper, erroneous operation may occur, and therefore, the gripper is preferably used. It is possible to use both of the gripper and the electrostatic attraction means. For the purpose of discrimination between the thick sheet and the plain paper sheet, the operator may input on an operation panel the nature of the transfer material.

Figure 2:
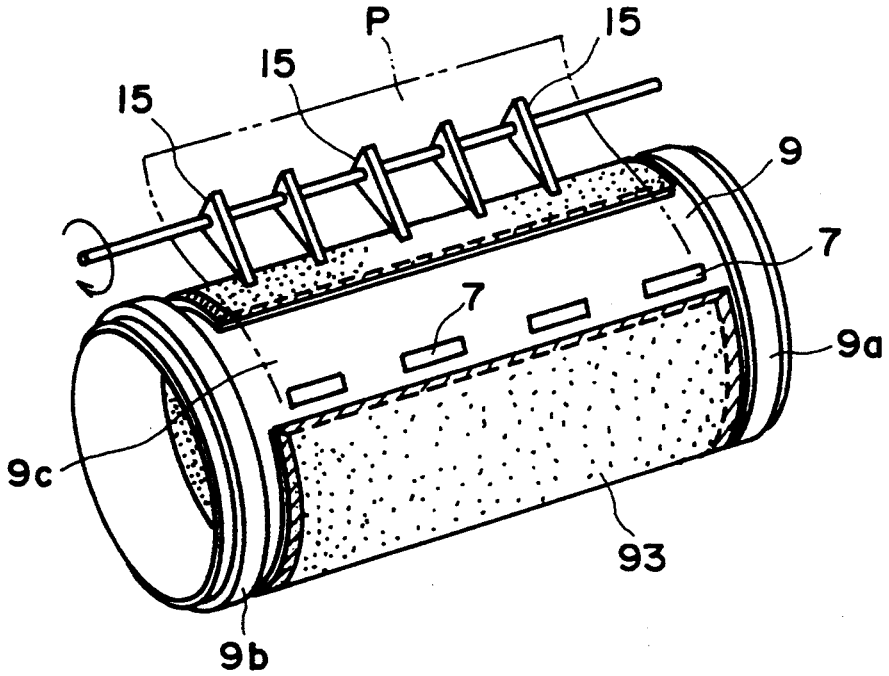
FIG. 2 is a perspective view of an example of an image transfer device.
Figure 3:
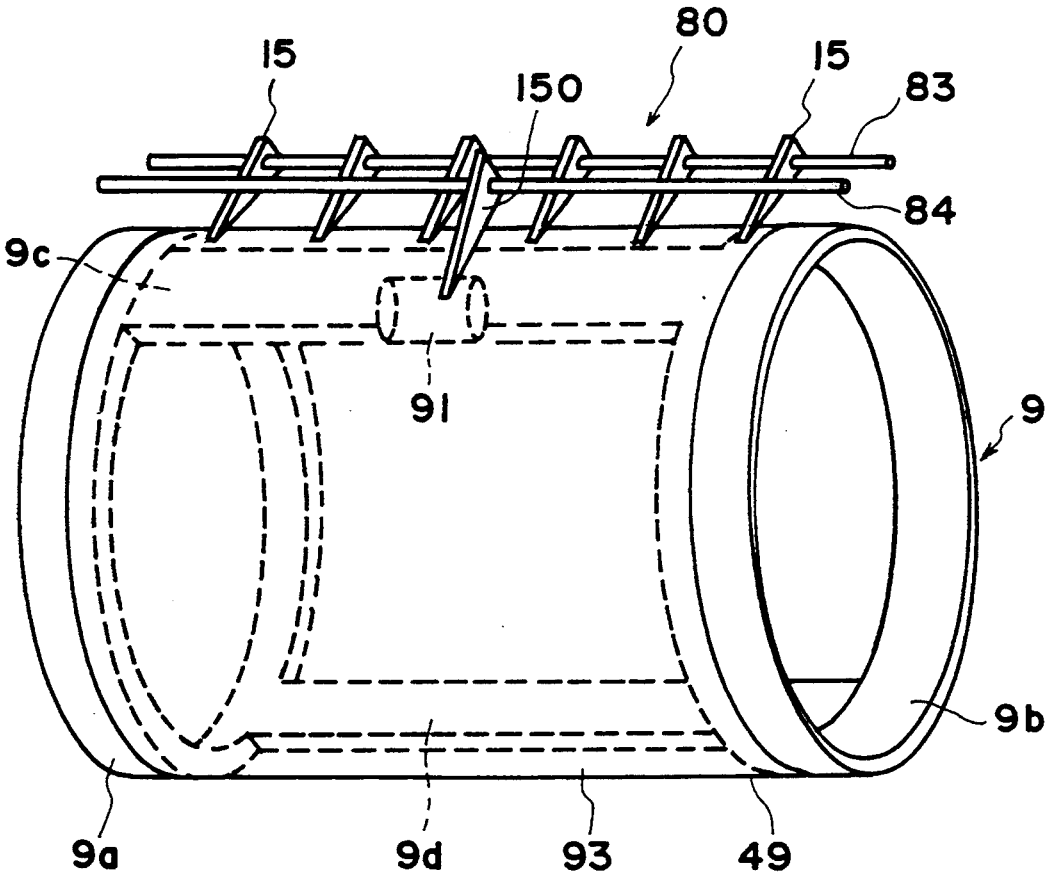
FIG. 3 is a perspective view of a transfer device according to a second embodiment of the present invention, usable with an image forming apparatus according to this invention.

FIG. 2 shows the separating action of the transfer material P which has been carried. In order to weaken the attraction force of the transfer material to a dielectric sheet 93, dischargers 11 and 13 (FIG. 1) are used to electrically discharge (AC). Thereafter, the gripper 7 opens outwardly in the radial direction of the transfer drum 9 by the cam. In the case of the electrostatic attraction, separation claws 15 are inserted to between the transfer material P and the dielectric sheet 93, so that the transfer material P is separated from the dielectric sheet 93. In order to facilitate the insertion of the separation claws 15 between the transfer material P and the dielectric sheet 93, a pressing roller 70 is provided inside the dielectric sheet 93 to urge the dielectric sheet 93 outwardly. In the case of the gripper type mechanism, 5–9 separation claws 15 are provided, which are disposed at regular intervals and at the same angles, so that the separation claws provide the same separating function and effects. When the separating timing comes, the separating claws 15 are contacting or moved toward the dielectric sheet 93 in response to a signal from control device (not shown). By doing so, the transfer material P is separated from a dielectric sheet 93 and thereafter, with the completion of the separation, it is returned to the original position by the releasing signal from the control device.

As shown in FIG. 2, the transfer drum 9 comprises a metal frame including a pair of rings 9*a* and 9*b* and a connecting portion 9*c* for connecting the ring portions 9*a* and 9*b*, and the dielectric sheet 93 covering the cutaway portion defined by the rings and connecting portions. Along the longitudinal direction of the connecting portion 9*c*, a plurality of grippers are mounted. Therefore, the transfer material in the B area of the transfer drum of FIG. 1 is not carried on the connecting portion 9*c*.

In the separating means of FIG. 2, the transfer material gripped by the gripper is properly separated, but in the case of the separation of the transfer material attracted by the electrostatic attraction, there is a higher possibility of improper separation because the attraction force of the transfer material to the dielectric sheet is stronger. The reasons will be described.

When the dielectric sheet is deformed at a plurality of positions by the separation claws for the purpose of separation, the gap for permitting insertion of the separation claws between the dielectric sheet and the transfer material, is narrow, and therefore, it is difficult for all of 5–9 separation claws are assuredly inserted.

When the separation claws are strongly urged to the dielectric sheet for the purpose of assuring the separation, the possibility of the damage of the dielectric sheet is increased with the result of more frequent replacements of the dielectric sheet. In view of this, the number of separation claws to be inserted first between the dielectric sheet and the transfer material is reduced to one, so that the gap for receiving the separation claws increases, thus reducing the possibility of the improper separation resulting from the number of separation claws.

If the one claw separating means were used for the separation of the transfer material carried by the gripper, the separation would be possible. However, there are sufficient gaps for receiving 5–9 separation claws 15 shown in FIG. 2. The possibility of the improper separation reduces when a plurality of separation claws are arranged in the direction of the width at regular intervals than when only one separation claw is used.

In order to separate the transfer material carried by the transfer material carrying means, the following is preferable. When the transfer material is carried by using the gripper, the plurality of separating members are inserted to between the transfer material and the recording material carrying member, and when the transfer material is carried by the electrostatic attraction means, a gap is formed at one position between the recording material and the recording material carrying member, and a first single separating member is inserted into the gap. This will be described in more detail. Similarly to the foregoing embodiment, a transfer material P1 is supplied to the transfer drum 9. The leading edge of the transfer material P1 is gripped by the gripper 7. Similarly to the case of FIG. 1, the transfer material is moved toward the transfer position T by the rotation of the transfer drum 9. The fundamental operation of the gripper 7 in this case is the same as described hereinbefore, and therefore, the detailed description thereof is omitted for simplicity. The first transfer material P1 is gripped by the gripper 7 when the dimension of the transfer material P1 measured in the feeding direction is shorter than the circumferential direction of the dielectric sheet 93, and the dimension of the next transfer material P2 (not shown) measured in the same direction is the same as that of the transfer material P1, namely, when the transfer materials P1 and P2 can be carried on the A area and B area. The second transfer material P2 is attracted on the dielectric sheet 93 by the corona charger 39 and the attraction roller 40 disposed opposed thereto. The attraction means, as shown in FIG. 1, is disposed within the transfer drum 9, and is constituted by the attraction corona charger 39 for applying to the backside of the dielectric sheet 93 the electric charge of the polarity opposite from that of the toner image on the photosensitive drum 3, and the electrically conductive attraction roller 40 outside the transfer drum 9. The attraction roller 40 is electrically grounded to function as an opposite electrode for the attraction corona charger 39, and is effective to inject the electric charge to the transfer material P2 to attract the transfer material P2 onto the dielectric sheet 93.

The transfer materials P1 and P2 attracted on the transfer drum 9 is fed to the transfer position T where the transfer charger 10 is disposed. In order to transfer onto the transfer materials P1 and P2 the first color developer, for example, the magenta toner image from the photosensitive drum 3, the transfer charger 10 in the form of a corona charger applies the electric charge of the polarity opposite from that of the toner to the backside of the dielectric sheet 93. By the time the transfer materials P1 and P2 come to the attraction means (39, 40) secondary, the attraction roller 40 is separated from the transfer drum 9, and is moved away (not less than 2 mm) from the dielectric sheet so that it does not disturb the toner images transferred onto the transfer materials P1 and P2.

Then, the second color toner image formed on the photosensitive drum 3 in synchronism with the transfer materials P1 and P2 having the first color toner images, is transferred onto the transfer materials P1 and P2 by transfer charger 10. Similarly, four color toner images are transferred onto the transfer materials P1 and P2.

In order to weaken the attraction force to the dielectric sheet 93 on the transfer materials P1 and P2 after the completion of the transfer step, there are provided an outside discharger 11 and an inside discharger 13 which constitute a pair of AC corona dischargers with the dielectric sheet 93 therebetween. By them, the transfer materials P1 and P2, and the dielectric sheet 93 are electrically discharged. Thereafter, by the separation means 80 including the separation claws 15 which will be described in detail hereinafter, the transfer material P is separated. In order to prevent the disturbance to the image due to the separation discharge at this time, it is preferable that the AC corona discharge is applied by the separation charger 14.

After the transfer and separation operations, the transfer materials P1 and P2 are fed to the fixing device 17 by a conveying device 24. By the application of the heat, the toner is mixed and fixed. Then, the sheet is discharged, thus completing the copying operation.

Figure 4:
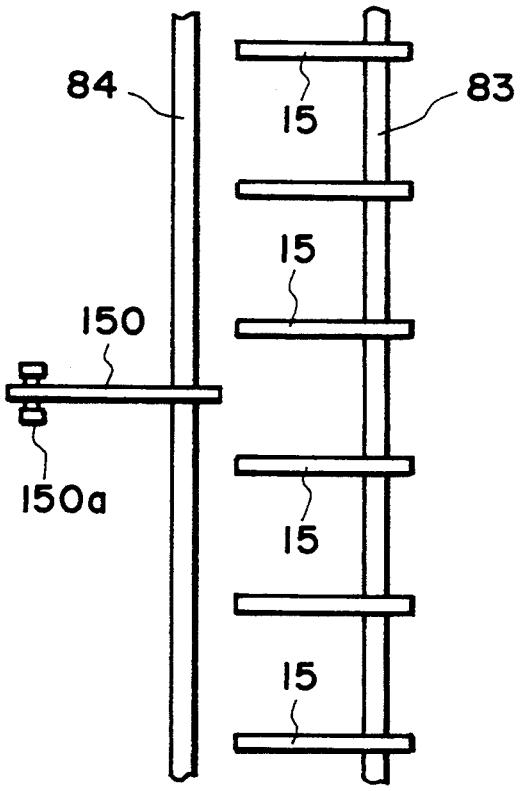
FIG. 4 is a top plan view of the device of FIG. 3.
Figure 5:
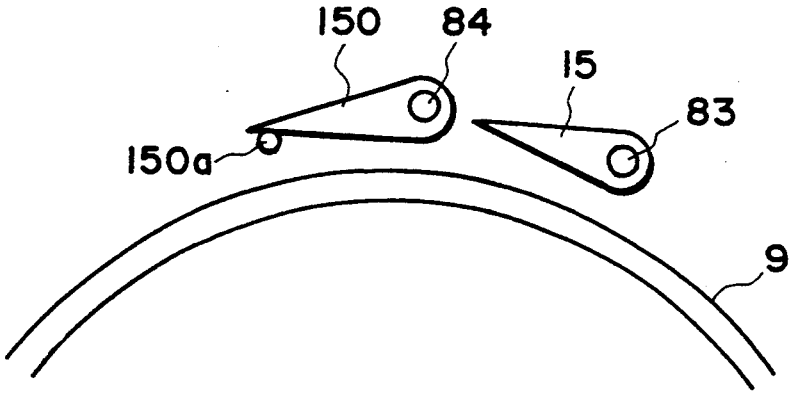
FIG. 5 is a side view of the device of FIG. 3.

The separating device will be described in detail. In this embodiment, the transfer drum 9 comprises cylindrical rings **9*a* and 9*b* at the opposite ends and connecting portions 9*c* and 9*d* for connecting the rings 9*a* and 9*b*. The rings 9*a* and 9*b* and connecting portions 9*c* and 9*d* constitute a frame 49 for supporting a transfer material carrying member, that is, the dielectric sheet 93 made of dielectric film. In this embodiment, the separating means 80 comprises separation claw supporting shafts 83 and 84 extended along the direction of the rotational axis of the transfer drum 9, 6 separation claws 15 on the shaft 83 and one separation claw 150 on the shaft 84. At an end of the separation claw 150, as shown in FIGS. 4 and 5, a guiding roller 150*a* may be provided integrally. In the connecting portion 9*c* of the transfer drum, a cut-away guiding groove 91 is formed to facilitate insertion of the edge of the separation claw 150 into the gap between the dielectric sheet 93 and the transfer material P electrostatically attracted on the dielectric sheet 93. The edge of the dielectric sheet 93 is bonded on the connecting portion 9*c* along a generating line passing through the cut-away guiding groove 91 of the connecting portion 9*c***, so that a seam is formed to the non-image region on the transfer material.

Figure 6:
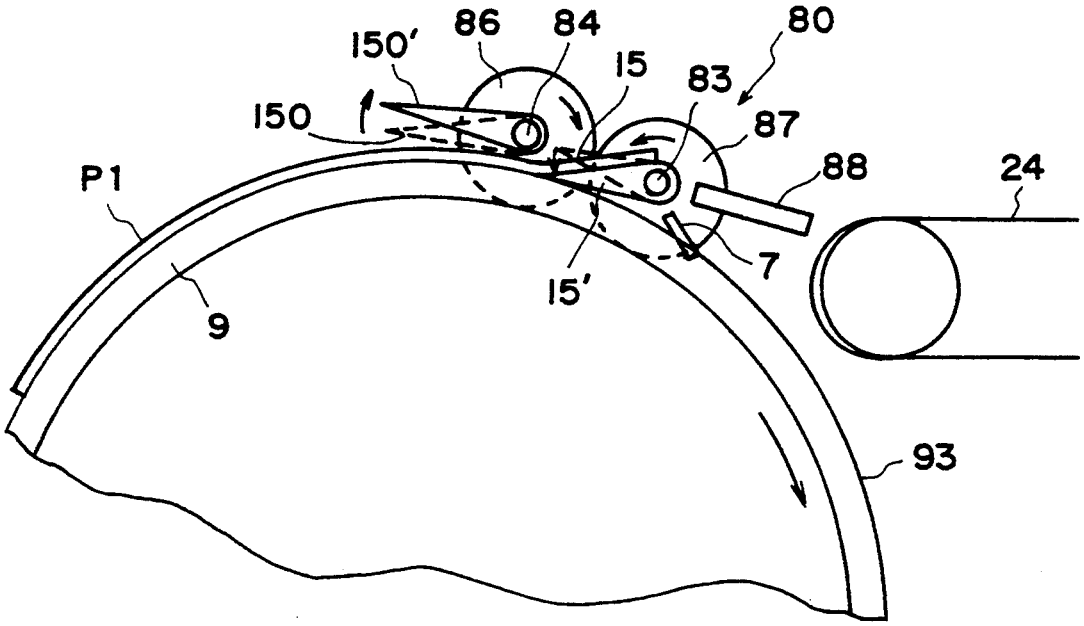
FIG. 6 is a side view illustrating separating means used in the transfer device of FIG. 3.
Figure 7:
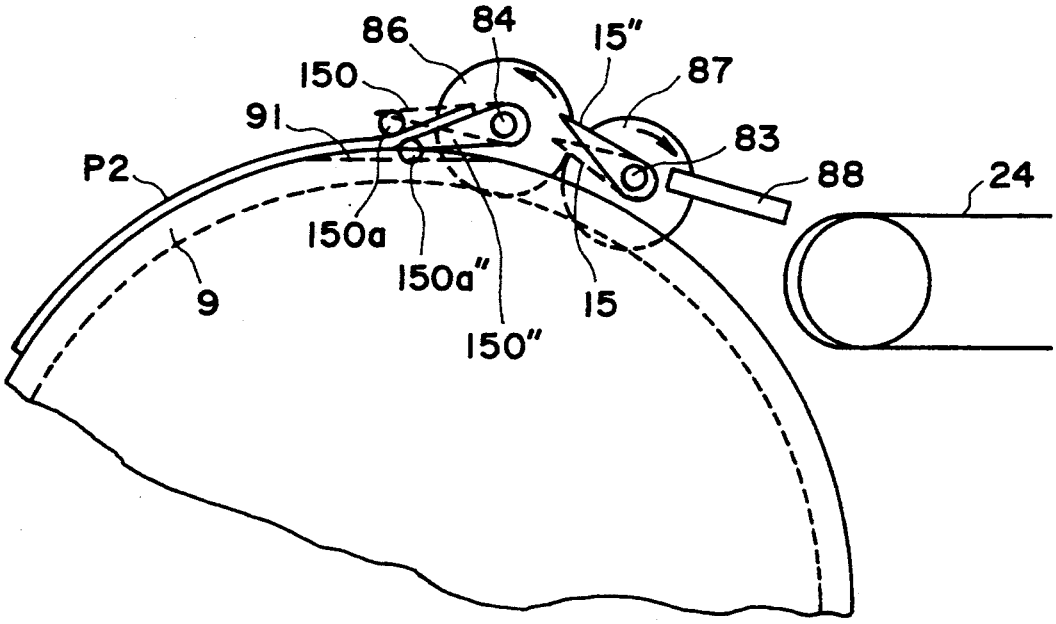
FIG. 7 is a side view illustrating separating means used with the transfer device of FIG. 3.

Referring to FIGS. 6 and 7, the separation means of this embodiment will be described. In FIGS. 6 and 7, there is provided gears 86 and 87 which are meshed together and fixed to the separation claw supporting shafts 83 and 84, respectively. There is also a guiding plate 84 for connecting the separating means 80 and the conveying device 24. When the transfer material P1 gripped by the gripper 7 and supported in the A area of the dielectric sheet 93 comes to the separating timing, the gripper, as shown in FIG. 6, opens outwardly in the radial direction of the transfer drum 9 to provide a sufficient gap between the transfer material P and the dielectric sheet 93. Then, the gear 87 is rotated in the direction of arrow by an unshown solenoid or the like to move the edge of the separation claws 15 toward the dielectric sheet 93 into the state indicated by 15' (solid line). By doing so, the edges of the separation claws 15 are inserted into the gap, so that the transfer material P1 is separated with the rotation of the transfer drum 9. By the rotation of the gear 86 in the direction indicated by an arrow, the edge of the separating claw 150 is in the position indicated by a reference numeral 150', that is, away from the dielectric sheet 93.

Then, when the transfer material P2 attracted on the B area of the dielectric sheet 93 comes to the separation timing, the gear 87 is rotated in the direction indicated by an arrow by an unshown solenoid or the like, as shown in FIG. 7, by this, the gear 86 following the gear 87, rotates in the direction indicated by an arrow to place the edge of the separation claw 150 in the state indicated by a reference numeral 150" to urge the guiding roller **150*a* to the guiding groove 91. Thus, the edge of the separation claw 150 is inserted to between the transfer material P2 and the transfer drum 9, by which the transfer material 2 is separated from one point with the rotation of the transfer drum 9**.

In this embodiment, by interrelating the gears 87 and 86, the separation claw 150 is moved away upwardly to prevent interference with the transfer material P1, in FIG. 6, so that the state indicated by the reference numeral 150' is established. In FIG. 7, the separation claws 15 are put into the state indicated by a reference numeral 15" (solid line), by which the transfer material P2 is guided from the separation point to the guiding plate 88.

Figure 8:
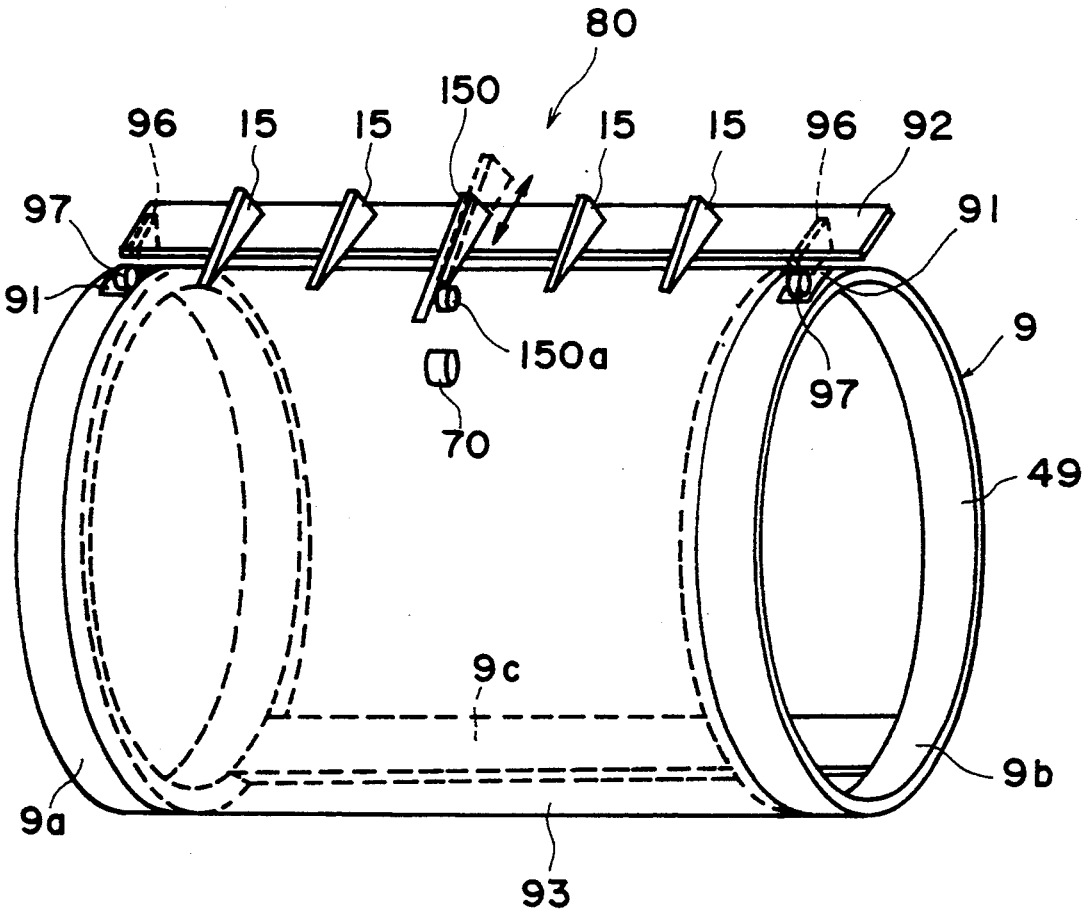
FIG. 8 is a perspective view of a transfer device according to a third embodiment of the present invention, usable with an image forming apparatus according to this invention.

The description will be made separating means according to another embodiment. The apparatus of this embodiment is the same as in FIG. 1 embodiment in the structure and operation, except for the separating means for the transfer device, and therefore, the detailed description thereof is omitted for simplicity. FIG. 8 shows the separating means according to a third embodiment of the present invention. In this embodiment, the transfer device comprises rings **9*a* and 9*b* and a connecting portion 9*c* with gripper for connecting the rings 9*a* and 9*b*. The rings 9*a* and 9*b* and the connecting portions 9*c* constitute a frame 49 for supporting a dielectric sheet 93** functioning as the transfer material carrying member.

In this embodiment, the separating means 80 comprises a separating claw supporting member 92 extended along an axis of the transfer drum 9, separating claws 15 and one separating claw 150, both on the supporting member 92. The edge of the single separating claw 150 is provided with an integral guiding roller **150*a*. The supporting member 92 is supported for vertical swinging of the separation claws 150 and the separation claw 150**, by an unshown solenoid.

Figure 9:
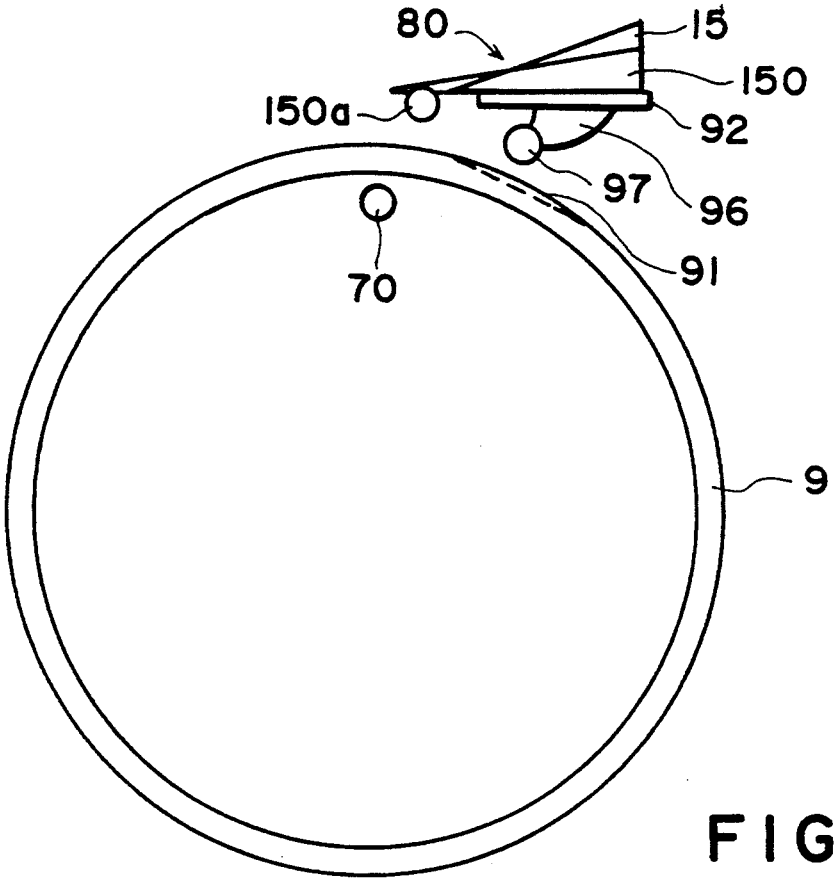
FIG. 9 is a side view illustrating separating means usable with the transfer device of FIG. 8.

According to this embodiment, as will be understood from FIGS. 8 and 9, abutment rollers 97 are provided at the opposite ends of the supporting member 92, using proper supporting plate 96. The abutment rollers 97 are contacted to the rings **9*a* and 9*b* of the transfer drum 9, when a separation clutch (not shown) is actuated. They are guided by the guiding grooves 91 formed in the rings 9*a* and 9*b* to rotate the edges of the separation claws 15 and the separation claw 50 downwardly, in the normal direction of the transfer drum 9. The rotating mechanism for the separation claws 15 and the separating claw 150, are not limited to this. Alternatively, a cam mechanism connected to the supporting plate 92** is usable.

Figure 10:
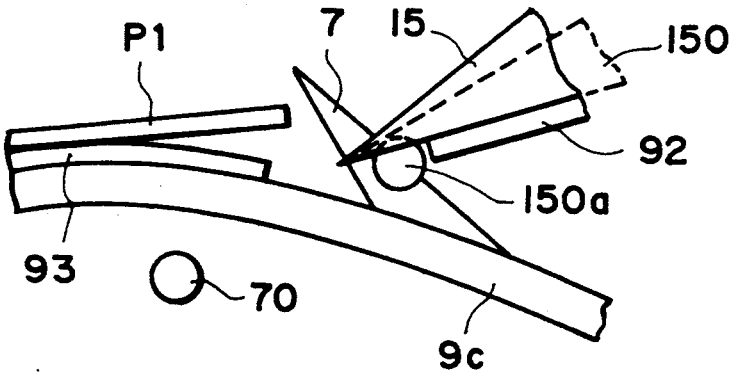
FIG. 10 is a side view illustrating the separating operation by the separating means usable with the transfer device of FIG. 8.
Figure 11:
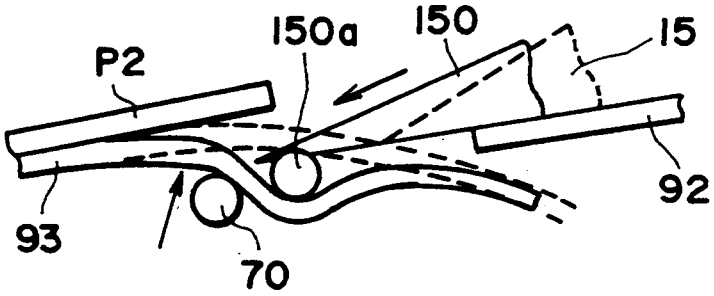
FIG. 11 is a side view illustrating the separating operation of the separating means used in the transfer device of FIG. 8.

Referring to FIGS. 10 and 11, the operation will be described. When the transfer material P1 supported on the A area of the dielectric sheet 93 by the gripper, reaches the separation timing, the gripper 7 opens outwardly, as shown in FIG. 10, to provide the sufficient gap between the transfer material P and the dielectric sheet 93 then the edges of the separation claws 15 and the separation claw 150 swing toward the dielectric sheet 93 by the above-described means to permit them enter the gap. Thus, the transfer material is separated with the rotation of the transfer drum.

When the transfer material P2 attracted on the B area of the dielectric sheet 93 by electrostatic attraction reaches the separation timing, the abutment roller 70 in the transfer drum 9 abuts the inside of the dielectric sheet 93 by an unshown swinging means, as shown in FIG. 11. The abutment roller 97 of the separating means is guided in the groove 91 at the opposite side of the connector **9*c* of the rings 9*a* and 9*b*, by which, the separation claw 150 swings to all the dielectric sheet 93. The separation claw 150 is advanced beyond the separating claws 15 by an unshown solenoid or the like. As a result, the guiding roller 150*a* integral with the separation claw 150 is urged from the outside to the dielectric sheet 93, thus changing the radius of curvature of the dielectric sheet at the location. By doing so, the leading edge of the transfer material P2 is separated by the radius of curvature. Then, the separation claw 150 and the separation claws 15 enter the gap between the transfer material P2 and the dielectric sheet 93, so that the transfer material P2 is separated. Upon completion of the separation, the separating claws are placed to the release position, and the inside roller 70** is moved away.

Upon the separation of the transfer meterial P2, as shown in the Figure, the separation charger 14 is operated to effect the AC corona discharging preferably in order to prevent the disturbance to the image by separation discharge which may occur when the transfer material P and the dielectric sheet 93 are separated.

Figure 12:
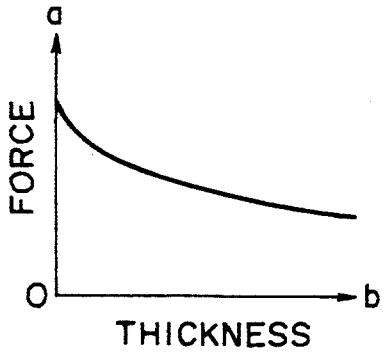
FIGS. 12, 13 and 14 are graphs showing relationships between the attraction force between the transfer material carrying sheet and the transfer material, and the transfer material thickness, the transfer current, the amount of toner.

When the length of the transfer material in the feeding direction is larger than one half of the length of the dielectric sheet 93, the attraction and separation are carried out by the gripper, and therefore, the discrimination is made by using the sensor 99 disposed in the transfer drum 9 and at a position where the transfer material P approach the transfer drum 9, as shown in FIG. 12, by which the roller 70 does not swing, and the separation claw 150 is not advanced forward.

In the foregoing description, the image forming apparatus is a color image forming apparatus. However, the present invention is applicable to a monochromatic image forming apparatus having a transfer device. The recording material carrying member is not limited to a cylindrical member, it may be in the form of a belt.

In such an image forming apparatus, if a superposed printing operation is carried out on a single transfer material, or overlaying printing is effected on a single transfer material, the following problems may arise.

Figure 17:
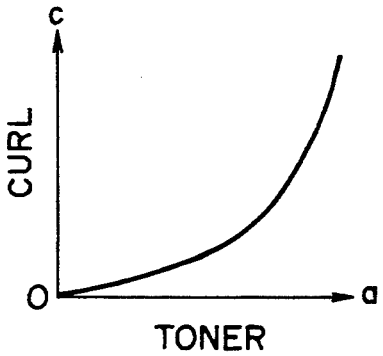
FIG. 17 is a graph showing a relationship between the amount of the toner on the transfer material and the amount of the curling of the transfer material.
Figure 18:
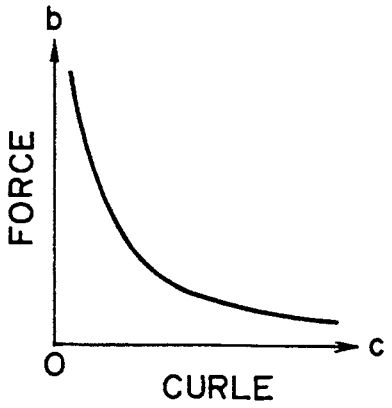
FIGS. 18 and 19 are graphs showing relationships between the transfer material attraction force of the transfer material carrying sheet and the curling amount of the transfer material or the amount of the deposited oil.

When the gripper is used in the duplex mode (both side printing), the image positions on the first and second sides may be deviated from each other. On the other hand, if the image is formed and fixed on a first side, and then, it is refed for the purpose of superposing or duplex printing, the attraction of the transfer material onto the transfer drum is not stabilized with the result of deterioration of the image quality and the frequent occurrence of jam, since the degree of curling of the transfer material is large in the second image transfer and since the oil used in the first image fixing is deposited on the transfer material. In the case of overlaying print, the amount of toner is larger, and in particularly the color print toner is resin toner to provide clear color. The contraction rate of the toner is different from the transfer material, with the result of curling by the contraction rate difference. This is a cause of instability of the support of the transfer material on the transfer drum. The relation between the amount of the toner and the degree of the transfer material curling, and the relation between the degree of curling and the attraction to the transfer drum, are shown in FIGS. 17 and 18.

Figure 19:
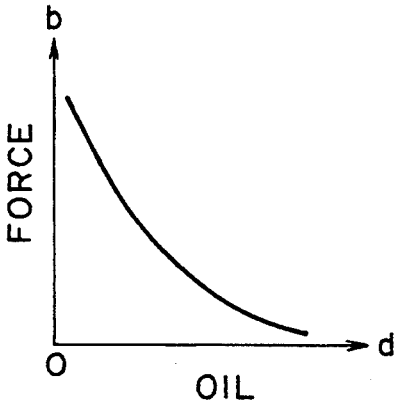

In the case of color printing, in order to improve the separation between the toner and the sheet fixing roller at the fixing position, a larger amount of silicon oil is used for the roller than in the case of monochromatic image formation. This may be deposited on the transfer material with the result of decreased attraction force to the photosensitive drum. The relation between the amount of the oil and the attraction force to the transfer drum is shown in FIG. 19.

Figure 20:
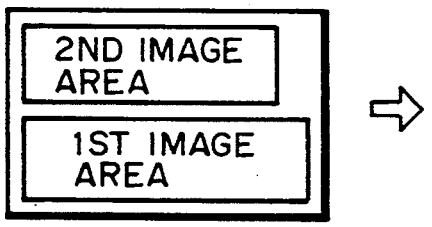
FIGS. 20, 21 and 22 illustrates a relation between the transfer material and the image position formed thereon in a superposing or duplex print mode.
Figure 21:
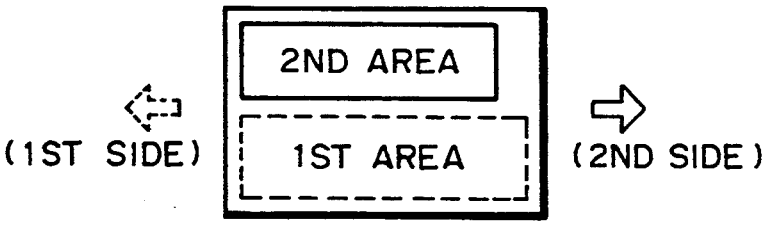
Figure 22:
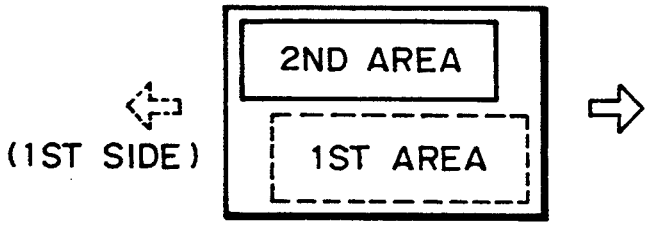

In order to avoid the defect of the transfer material support by the electrostatic force, it is preferable that the transfer material is supported, using a gripper, in the second and subsequent image formations. However, as described hereinbefore, if the gripper is used, a large untrasferable margin results at the leading end portion of the transfer material. In the case of duplex and superposing print, the image areas on the first side and the second side are deviated, as shown in FIGS. 20, 21 or 22. In FIG. 20, the transfer material is first supported without using the gripper and is second supported, using the gripper in the overlaying mode. In FIG. 21, the transfer material is first supported without using the gripper, and is secondary supported using the gripper in the duplex mode. In FIG. 21, the transfer material is firstly and secondly supported using the gripper in the duplex mode. The image area means the area in which the image is formable for given information. If the gripper is used at the first image formation, the position of the top margin of the image is reversed in the second image, as shown in FIG. 22.

In an image forming apparatus in which the same transfer material is refed as in the duplex or overlaying mode, control means is provided to control the position, size and the color so that the first side and the second side are aligned, in response to the image information reading and the output signal thereof. Alternatively, in an image forming apparatus in which the transfer material is fixed on the transfer material carrying sheet by electrostatic force or gripper, there are provided means for detecting the image information, the image formation mode and the material of the transfer sheet. On the basis of the outputs of these detecting means, the electrostatic force attraction or gripper support are selected on the basis of the outputs of the detecting means to support the transfer material on the transfer material carrying member in the second and subsequent image formation. By doing so, in an image forming apparatus capable of duplex and/or overlaying transfer and having a transfer material carrying member, the proper image transfer operation is assured, and in addition, the position of the image relative to the transfer material is made uniform. Furthermore, the transfer material is properly supported on the transfer material carrying member, thus improving the operation efficiency.

Figure 23:
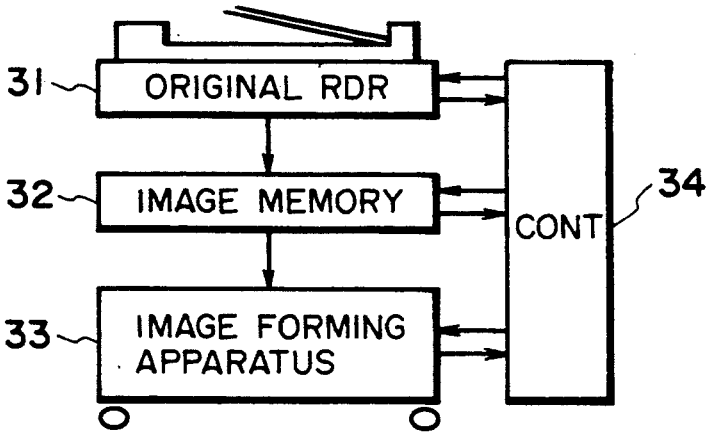
FIG. 23 is a control block diagram, according to an embodiment of the present invention.
Figure 24:
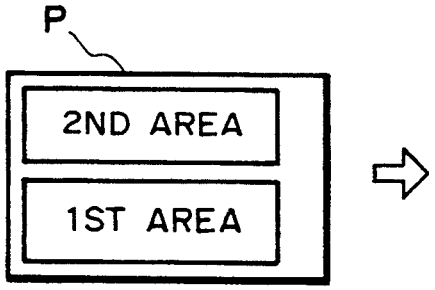
FIGS. 24 and 25 illustrate the positional relation between the image and the transfer material, when the present invention is used.
Figure 25:
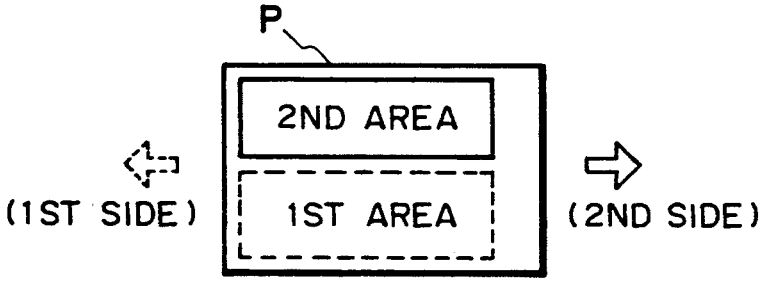

The description will be made as to prevention of positional deviation between the plural images in the case of duplex or overlaying printing. FIG. 23 is a block diagram of the apparatus of this embodiment. The image information of an original is read by a reader 31, and is stored in an image memory 32. When the first image formation is carried out by a control device (the transfer material is not gripped by the gripper), a margin is provided in preparation for the gripping by the gripper in the second image formation at the leading end portion with respect to the feeding direction of the transfer material (white arrow), in the case of the overlaying or superimposing mode (FIG. 24). In the case of the duplex mode, the margin is provided at the trailing edge portion (FIG. 25). In the case of the duplex mode, the transfer material feeding direction is different between the first image transfer and the second image transfer, and therefore, the similar margins are provided for the first and side image formations for the transfer material. When the gripper is used, the width of the margin at the leading edge of the transfer material is larger than when the gripper is not used.

By effecting the image forming operation in this manner, the images can be correctly positioned in the overlaying and duplex mode. Since the length of the transfer material is changed by the image fixing operation for the first image formation, and since the coloring nature in the second image transfer is different from that in the first image formation, they are compensated for by the adjustment in the second image forming operation.

The description will be made as to an embodiment in which the electrostatic attraction force and the gripper are selectively usable as the means for supporting the transfer material on the transfer material carrying member.

The electrostatic force acting on the transfer material carried on the transfer material carrying member changes depending on the following condition.

(1) Material or nature of the transfer material:

Yielding strength of the transfer material (rigidity of the sheet (sheet thickness)). This is shown in FIG. 12.

Figure 13:
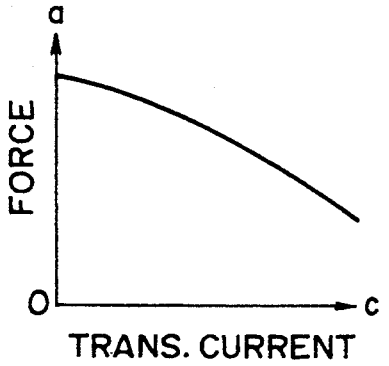

(2) Copy mode:

Monochromatic, two colors, three colors and four colors. The number of transfer charge receiving operations is different with the result of attraction force change, as shown in FIG. 13.

Figure 14:
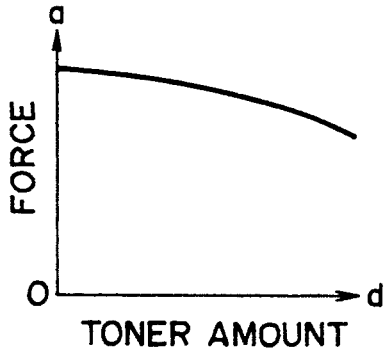

(3) Image information:

Depending on the amount of the toner on one transfer material, the attraction force varies as shown in FIG. 14.

(4) Ambient condition:

The discharge efficiency of the attraction charger changes depending on temperature and humidity of the ambience.

(5) Re-use:

In the case of the overlaying and duplex color print, the image forming operation is carried out after the transfer material passes through the fixing device, and therefore, the attraction force varies depending on the amount of oil deposited on the front side of the transfer material and depending on the amount or degree of the curling of the transfer material. The change of the attraction force depending on the degree of the curling is shown in FIG. 18, and the change of the attraction force depending on the amount of oil is shown in FIG. 19.

Figure 15:
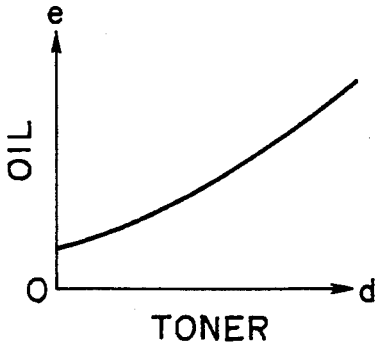
FIG. 15 is a graph showing a relationship between the amount of the toner on the transfer material and the amount of oil on the transfer material.
Figure 16:
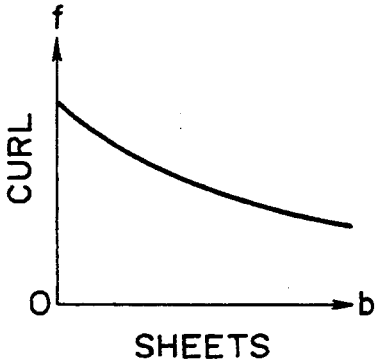
FIG. 16 is a graph showing a relationship between a thickness of the transfer material and the amount of curling.

Among them, the amount of the curl, as shown in FIGS. 16 and 17, is determined by the thickness of the transfer material and the amount of the toner. As shown in FIG. 15, the amount of the oil is determined by the toner amount. Therefore, if this is taken into account together with the sheet thickness influential to the attraction force, the toner amount, the oil amount or the like, the attraction force between the transfer material carrying member and the transfer material in the overlaying and duplex mode, is determined on the basis of the amount of image information on the first and second side, that is, the amount of the toner, the image formation mode, and the nature of the transfer material.

Figure 26:
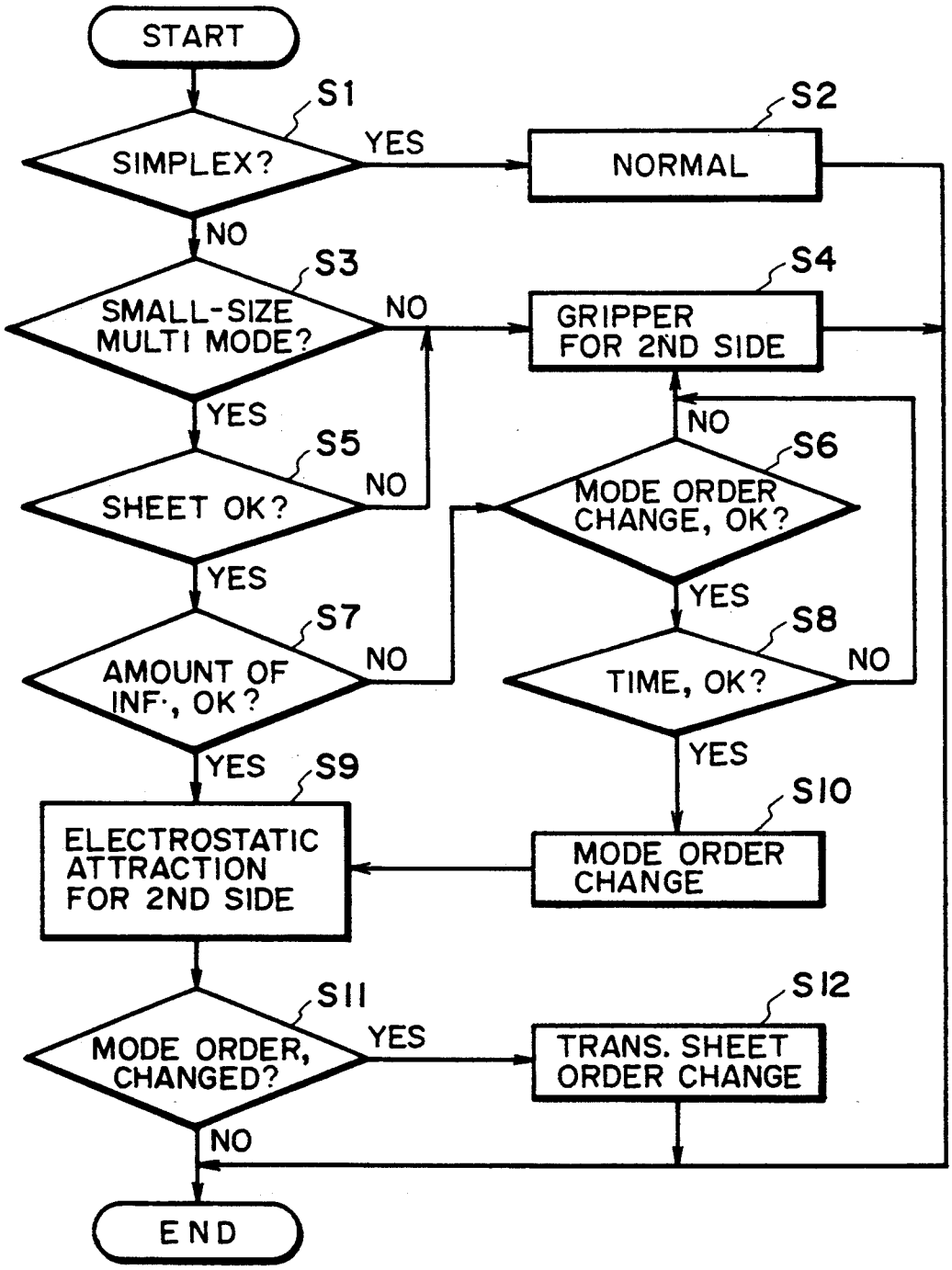
FIG. 26 is a flow chart of operations, according to a further embodiment of the present invention.

In this embodiment, in view of the above, an image forming apparatus is provided in which the transfer material can be carried on the transfer material carrying member in good conditions. This will be described, referring to the flow chart of FIG. 26. For the purpose of description, the image forming apparatus uses an automatic document feeder of circulation type in which one or more originals are stacked on the document feeder. The image forming number and the mode are set. It is discriminated whether or not the image is formed only on one side (S1). If only one side image formation (simplex mode), the operation proceeds to step S2, and the normal copying operation is carried out.

If the size of the transfer material is small, and the number of the transfer material is plural in the duplex or overlaying mode, the data is used which has been stored as to whether the attraction to the transfer material carrying member is difficult or not. When the material of the transfer sheets are exchanged by exchanging the cassette, the data are exchanged for the new cassette. Thus, the data are stored for the respective cassettes. Immediately after the exchange of the transfer material, if there is no data, the set image formation mode is used as the new data.

If the second attraction may involve a problem, the use of gripper is selected (step S4), and the image forming operation is carried out using the gripper. The similar discrimination is made on the basis of the material of the transfer sheet (S5). If it is a thick sheet, or if the curling amount will be a problem, the operation proceeds to S4 to use the gripper, and the image formation is carried out.

Then, the amount of image information (toner amount) is discriminated at step S7. If the non-use for the first and second side, is of no problem, the operation proceeds to steps S9 and S11 to effect the image forming operation. If the image information of the first side is large with the result of greater curling, or the oil amount by the first image information is large, or when the second side is monochromatic image resulting in smaller amount of toner, or the like, the attraction may be a problem in the second image formation. In such a case, the order of the first image information and the second image information is exchanged using the document circulation feeder. By doing so, the electrostatic attraction in the second image formation will not be a problem, and therefore, the operation proceeds through steps S6, S8 and S10 to step S9. In this case, when the electrostatic attraction on the second side is a problem irrespective of the order of image formations, the operations are carried out from step S6 to step S4 in the second image formation to use the gripper. If the use of gripper is quick as compared with the change of the order, the gripper is used in the second image forming operation.

When the order is changed, the operation proceeds from S11 to S12 to reverse the transfer material, and correct the order of sorting onto the bins of a sorter.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

recording material carrying member for carrying a recording material;

image forming means for forming an image on the recording material carried on said recording material carrying member;

gripper means for gripping the recording material on said recording material carrying member;

electrostatic attraction means for attracting a recording material on a recording material carrying member without gripping the recording material by said gripping means.

2. An apparatus according to claim 1, further comprising separating means for separating the recording material from said recording material carrying member, wherein said separating means includes a plurality of separating members first inserted to between said recording material carrying member and the recording material upon separation of the recording material gripped by said gripping means, and a single separating member first inserted to between said recording material carrying member and the recording material upon separation of the recording material not gripped by said gripping means.

3. An apparatus according to claim 1, wherein said recording material carrying means is capable of carrying a first recording material gripped by said gripping means and a second recording material attracted by said attracting means, simultaneously.

4. An apparatus according to claim 3, wherein said first and second recording materials are of plain paper.

5. An apparatus according to claim 3 or 4, wherein lengths of said first and second recording materials, measured in a direction of movement of said recording material carrying member, is smaller than one half of a circumferential length of said recording material carrying member.

6. An apparatus according to claim 1, wherein the recording material is selectively gripped by said gripping means or attracted by said attracting means, depending on material of the recording material.

7. An apparatus according to claim 6, wherein when the recording material is a thick sheet, it is gripped by said gripping means.

8. An apparatus according to claim 7, wherein the thick sheet is gripped by said gripping means, irrespective of a size thereof.

9. An apparatus according to claim 3, wherein the first recording material is carried on said recording material carrying member, prior to the second recording material.

10. An apparatus according to claim 1, wherein when the recording material is of plain paper, the recording material is gripped by said gripper means if a length of the recording material measured in the direction of movement of the recording material carrying member is larger than one half of a circumferential length of said recording material carrying member.

11. An apparatus according to claim 1, wherein when a length of the recording material measured in a direction of movement of said recording material carrying member is larger than one half of a circumferential length of said recording material carrying member, the recording material is gripped by said gripping means, irrespective of the material of said recording material.

12. An apparatus according to claim 1, wherein said apparatus is capable of forming an image on the recording material on which a first image has been fixed, and wherein a region of said recording material in which image formation is possible, is substantially aligned between first image formation and second image formation.

13. An apparatus according to claim 1, wherein said apparatus is capable of forming an image on a second side of the recording material after an image is fixed on a first side of the recording material.

14. An apparatus according to claim 13, wherein regions on the recording material where image formation is possible, of the first and second sides of the recording material, are substantially aligned.

15. An apparatus according to claim 14, wherein when an image is formed on the second side of the recording material, the recording material is gripped by said gripper means.

16. An apparatus according to claim 13, wherein when an image is formed on a first side of the recording material, a width of a trailing margin of the recording material is larger than a width of a leading margin of the recording material.

17. An apparatus according to claim 14, 15 or 16, further comprising storing means for storing image information.

18. An apparatus according to claim 13, wherein upon image formation on the second side of the recording material, the recording material can be gripped by said gripper means.

19. An apparatus according to claim 18, wherein when image is formed on the first side of the recording material, the recording material can be attracted by said attraction means.

20. An apparatus according to claim 13, wherein the recording material is carried on said recording material carrying member using said gripper means or using said attraction means upon second image formation, depending on the number of image formations on the recording material.

21. An apparatus according to claim 13, wherein said image forming means is capable of forming a toner image on the recording material, and the recording material is carried on said recording material carrying member selectively by said gripper means or by said attraction means, depending on an amount of toner of the toner image.

22. An apparatus according to claim 13, wherein an order of first and second image formations is changeable in accordance with image information to be formed on the recording material.

23. An apparatus according to claim 22, wherein an order of first and second image formations is changed, the recording material is carried on said recording material carrying member by said attraction means in second image formation.

24. An apparatus according to claim 1, wherein said attraction means electrostatically attracts the recording material on said recording material carrying member.

25. An apparatus according to claim 1, wherein said image forming means comprises an image bearing member on which a toner image is formed, and transfer means for transferring the toner image onto the recording material carried on said recording material carrying member from said image bearing member.

26. An apparatus according to claim 25, wherein a plurality of such toner images can be superposedly transferred onto the recording material carried on said recording material carrying member.

27. An apparatus according to claim 26, wherein said image forming apparatus is capable of forming a full-color image on the recording material.

* * * * *

UNITED STATES PATENT AND TRADEMARK OFFICE

CERTIFICATE OF CORRECTION

PATENT NO. : 5,406,358

DATED : April 11, 1995

INVENTOR(S) : KOJI KIMURA, ET AL.

It is certified that error appears in the above-indentified patent and that said Letters Patent is hereby corrected as shown below: In the drawings:

Figure 18,

"CURLE" should read --CURL--.

Column 1, line 31, "the" (second occurrence) should be deleted;
line 33, "the" should read --if the--;
line 41, "with the result of" should read --causing--;
line 56, "the" should read --another--; and
line 57, "ing is carried." should read --ing material is carried by the recording material carrying member.--.

Column 2, line 44, "illustrates" should read --illustrate--.

Column 3, line 47, "materials" should read --material--.

Column 4, line 32, "to" should be deleted;
line 44, "contacting" should read --contacted--; and
line 45, "from" should read --from a--.

UNITED STATES PATENT AND TRADEMARK OFFICE

CERTIFICATE OF CORRECTION

PATENT NO. : 5,406,358
DATED : April 11, 1995
INVENTOR(S) : KOJI KIMURA, ET AL.

It is certified that error appears in the above-indentified patent and that said Letters Patent is hereby corrected as shown below:

Column 5,
line 6, "are assuredly" should be --to be--;
line 30, "to" should be deleted; and
line 55, "opposed" should read --opposite--.

Column 6,
line 2, "is" should read --are--;
line 38, "of the" should read --of--; and
line 67, "is" should read --are--.

Column 7,
line 10, "of" should read --of the--.

Column 8,
line 19, enter" should read --to enter--.

Column 9,
line 8, and the" should read --and--, and "oc-" should be deleted;
line 9, "currence of jam," should read --jamming,--; and
line 45, "secondary" should read --then--.

UNITED STATES PATENT AND TRADEMARK OFFICE

CERTIFICATE OF CORRECTION

PATENT NO. : 5,406,358

DATED : April 11, 1995

INVENTOR(S) : KOJI KIMURA, ET AL.

It is certified that error appears in the above-indentified patent and that said Letters Patent is hereby corrected as shown below:

Column 10,
line 27, "and" should read --and second--; and
line 46, "condition." should read --conditions.--.

Column 11,
line 18, "side," should read --sides,--; and
Col. 12, line 43, "means" should read --member--.

Column 14,
linr 4, "image" should read --an image--.

Signed and Sealed this

Eighteenth Day of July, 1995

Bruce Lehman

*Attest:*

BRUCE LEHMAN

*Attesting Officer*

*Commissioner of Patents and Trademarks*